US006202534B1

(12) United States Patent
Baxter et al.

(10) Patent No.: US 6,202,534 B1
(45) Date of Patent: Mar. 20, 2001

(54) VARIABLE SPEED COMMON AXIS CONTROL SPROCKETS USED IN A SHELL CASING UNLOADING DEVICE

(75) Inventors: David R. Baxter, Waterbury Center; Edward A. Prouix, Burlington; Bernard A. Derry, Essex Junction, all of VT (US)

(73) Assignee: General Dynamics Armament Systems, Falls Church, VA (US)

( * ) Notice: Subject to any disclaimer, the term of this patent is extended or adjusted under 35 U.S.C. 154(b) by 0 days.

(21) Appl. No.: 09/229,587

(22) Filed: Jan. 13, 1999

Related U.S. Application Data

(60) Provisional application No. 60/071,431, filed on Jan. 14, 1998.

(51) Int. Cl.[7] ..... F41A 9/00
(52) U.S. Cl. ..... 89/33.25; 89/33.17; 89/33.16
(58) Field of Search ..... 89/33.25, 33.16, 89/33.17, 33.04

(56) References Cited

U.S. PATENT DOCUMENTS 4,270,436 * 6/1981 Bishop et al. ..... 89/33
4,328,737 * 5/1982 Nelson et al. ..... 89/33
4,505,181 * 3/1985 Schneider et al. ..... 89/33.04
4,932,307 * 6/1990 Menges et al. ..... 89/33.04

OTHER PUBLICATIONS

IDF 20MM Gun System–Lockheed Martin; Nov. 20, 1996.
Engineering Change Proposal for 20MM Gun System: (ECP) No. IDF–5606–0013; Mar. 21, 1997.

* cited by examiner

*Primary Examiner*—Michael J. Carone
*Assistant Examiner*—Michelle Thomson
(74) *Attorney, Agent, or Firm*—Finnegan, Henderson, Farabow, Garrett & Dunner, LLP

(57) ABSTRACT

A handling system for brass shell casings in an ammunition handling system. A shaft has a first sprocket and first hub and a non-circular gear mounted thereto, and because of the non-circular gear, rotates at a variable speed when driven by a power source. A second hub, coaxial with the shaft and rotatable independently of the shaft, has a second sprocket and a circular gear mounted thereto, and because of the circular gear, rotates at a selected speed when driven by the power source. The speed of the first sprocket varies between being equal to the speed of the second sprocket to being less than the speed of the second sprocket so that one end of a shell casing mounted on the two sprockets first lags behind the other end of the shell casing, then catches up to the other end of the shell casing.

34 Claims, 3 Drawing Sheets

VARIABLE SPEED COMMON AXIS CONTROL SPROCKETS USED IN A SHELL CASING UNLOADING DEVICE

This application claims the benefit of provisional patent application Ser. No. 60/071,431, filed Jan. 14, 1998.

BACKGROUND OF THE INVENTION

1. Field of the Invention

The present invention relates to a gun system, and an ammunition handling system for a gun. More particularly, the present invention relates to a shell casing unloading device used in the ammunition handling system of a high rate of fire automatic gun.

2. Description of the Related Art

Automatic high rate of fire guns, for example 20 mm M61A1 Gatling-type guns used in fighter aircraft, are mated with ammunition handling systems that deliver a steady supply of rounds to the gun (each round including a shell and a brass shell casing), remove the spent shell casings from the gun, and store the spent shell casings to preclude their ingestion by the aircraft's engine(s).

FIG. 1 depicts an ammunition handling system used with a high rate of fire gun. A continuous conveyor belt 21 feeds rounds into a storage drum 22. The rounds leaving the drum are reinserted into the conveyor belt, then fed via a loading sprocket 24 into a gun 26. Each round includes a shell 27 and a shell casing 28. An unloading sprocket 30 takes the spent shell casings 28 from the gun 26. Unloading sprocket 30 rotates within the housing of a transfer unit 31.

FIG. 2 depicts a conventional unloading sprocket 30. The sprocket 30 includes a forward sprocket 32 and an aft sprocket 34. The two sprockets are fixed together by a hub 36, and therefor rotate in unison.

FIG. 3 broadly depicts the aft end "a" of a shell casing 28 and the forward end "f" of the shell casing.

In normal operation, high rate of fire gun mechanisms are subjected to severe accelerations in multiple directions. When subjected to such accelerations, the forward end "f" of shell casing 28 in the conventional unloading sprocket 30 can become bound between the forward sprocket 32 and a gun guidebar. This interference can result in the forward end "f" of shell casing 28 being dented.

Dented shell casings may be deformed to an extent that is physically incompatible with the high speed mechanisms contained in the ammunication handling system, causing these mechanisms to jam and, in some instances, be damaged as the dented shell casing is processed through them. In an extreme case, this damage may render the gun system inoperable.

SUMMARY OF THE INVENTION

The present invention is directed to an ammunition handling system and a shell casing unloading device used in an ammunition handling system that substantially minimizes one or more of the problems due to the limitations and disadvantages of the related art.

The principal advantage of the present invention is the incorporation of a shell casing unloading device that substantially reduces the number of dented shell casings.

Additional features and advantages of the invention will be set forth in the description which follows, and in part will be apparent from the description, or may be learned by practice of the invention. The advantages of the invention will be attained by the apparatus particularly pointed out in the written description and claims below, as well as the attached drawings.

To achieve the advantages of the invention, an ammunition handling system includes a loading sprocket for feeding a round into a gun, the round including a shell and a shell casing, and an unloading device for unloading the shell casing from the gun. The unloading device includes a first rotatable shaft having a first circular gear and a first non-circular gear fixed thereto, the first shaft being drivable by a power source. A second rotatable shaft is provided having a second non-circular gear fixed thereto and engaged with the first non-circular gear, and a first sprocket and first hub fixed thereto to rotate with the second shaft. A second sprocket and second hub nominally aligned with the first sprocket is mounted around a reduced diameter portion of the first hub to be rotatable independently of the second shaft, having a second circular gear engaged to rotate with the first circular gear.

Based on the circular shape of the first and second circular gears, the second sprocket will rotate at a generally constant velocity. However, based on the non-circular shape of the first and second non-circular gears, the second shaft and the first sprocket will rotate at a variable velocity.

The first sprocket is the forward sprocket, handling the forward end "f" of the shell casing, and the second sprocket is the aft sprocket, handling the after end "a" of the shell casing. The variable velocity of the forward sprocket, which includes slowing down below the speed of the aft sprocket then accelerating to catch up with the speed of the aft sprocket, enables the forward end "f" of the shell casing to avoid a random binding condition of the forward end "f" of the shell casing between the guide bar and the forward sprocket, thereby avoiding denting of the forward end "f" of the shell casing.

In another aspect of the invention, the unloading device includes a first rotatable shaft having a first circular gear and a first non-circular gear fixed thereto, the first shaft being drivable by a power source. A second rotatable shaft has a second non-circular gear fixed thereto and engaged with the first non-circular gear, and a first sprocket fixed to the second shaft to rotate therewith. A second circular gear is coupled to a second sprocket, which is provided generally coaxially aligned with the first sprocket, and the second circular gear is engaged with the first circular gear.

It is to be understood that the foregoing general description and the following detailed description are exemplary and explanatory, and are intended to provide further explanation of the invention as claimed.

BRIEF DESCRIPTION OF THE DRAWINGS

The accompanying drawings are included to provide a further understanding of the invention. They constitute a part of the specification, illustrate a preferred embodiment of the invention, and together with the description serve to explain the principles of the invention.

DESCRIPTION OF THE PREFERRED EMBODIMENTS

Reference will now be made in detail to the present preferred embodiments of the invention, one example of which is illustrated in the accompanying drawings.

Figure 1:
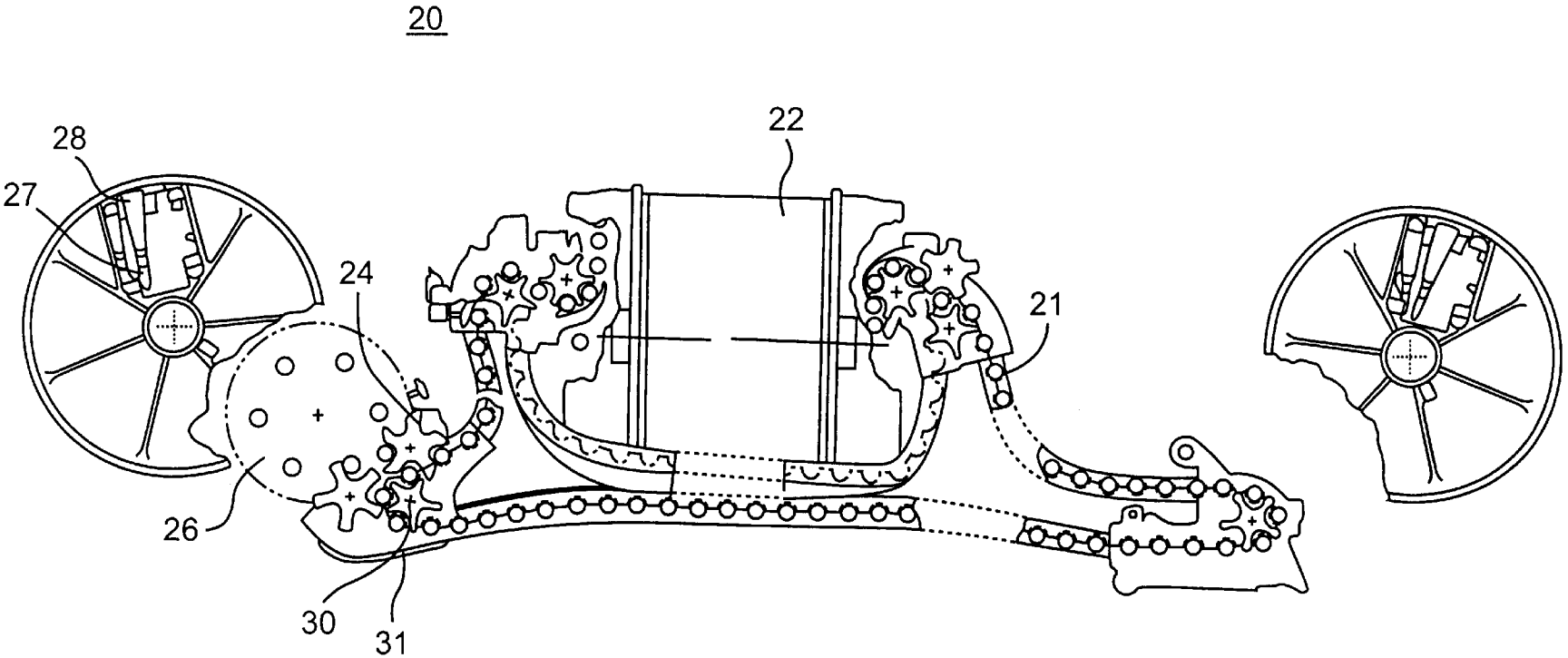
FIG. 1 PRIOR ART
FIG. 1 is a schematic rear view of an ammunition handling system used with a high rate of fire gun.
Figure 2:
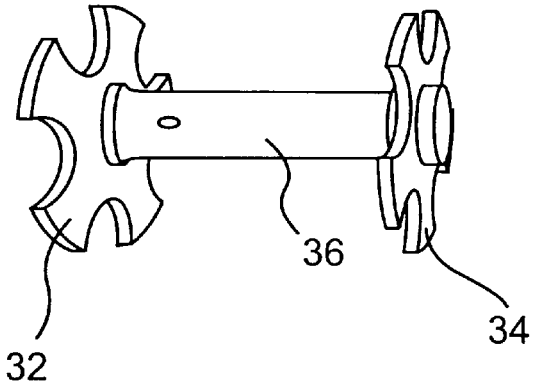
FIG. 2 PRIOR ART
FIG. 2 is a perspective view of a conventional shell casing unloading sprocket.
Figure 3:
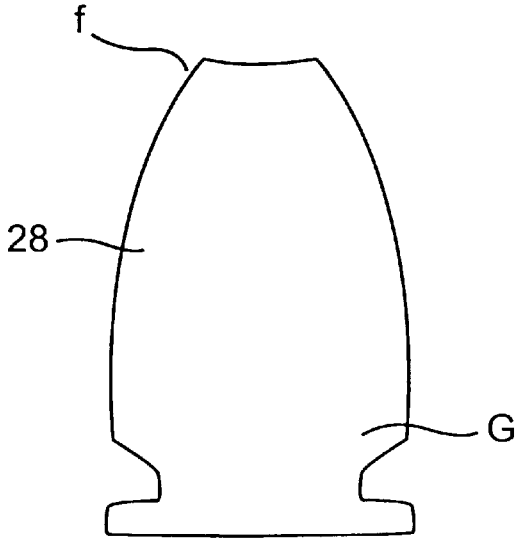
FIG. 3 PRIOR ART
FIG. 3 is a top view of a shell casing.

As described above, an ammunition handling system, designated by reference numeral 20, is shown in FIG. 1. The system includes a conveyor belt 21, feeding rounds into a storage drum 22, then fed via an ammunition loading sprocket 24 into a gun 26. Each round includes a shell 27 and a shell casing 28. These portions of the invention are conventional, and therefore will not be described in further detail.

Figure 4:
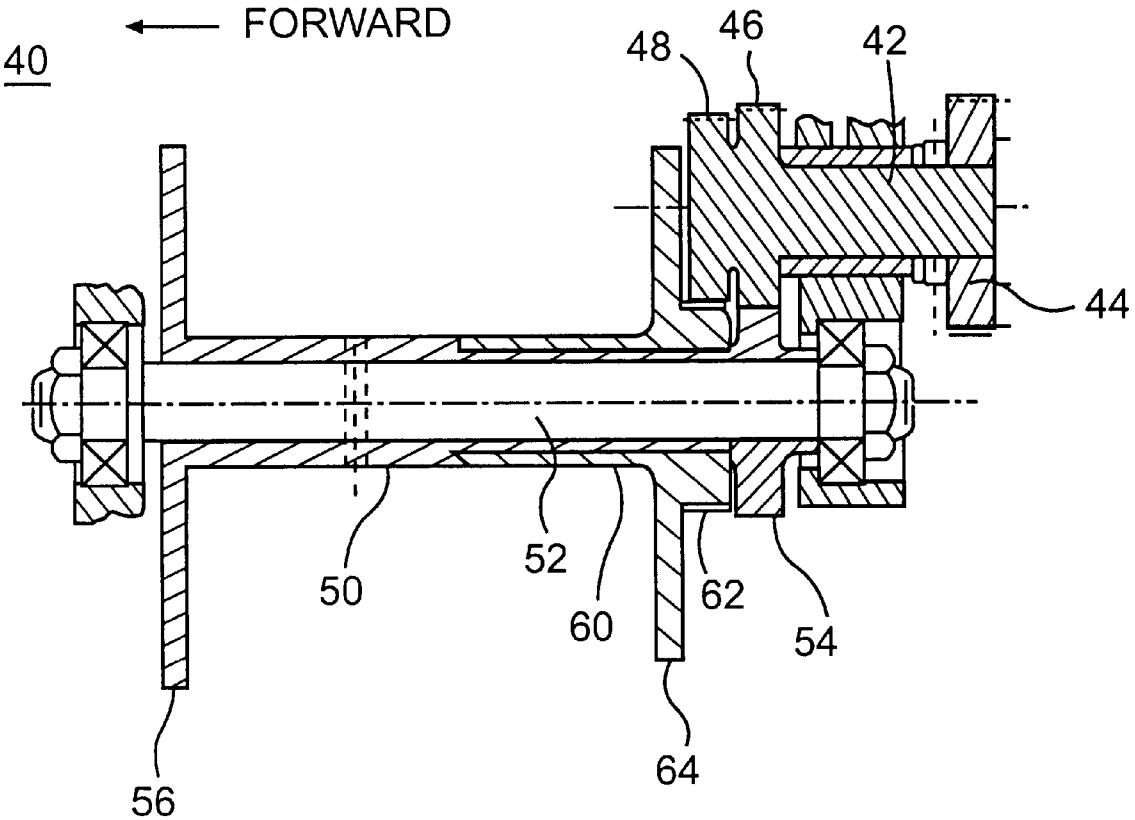
FIG. 4 is a side cross-sectional view of a preferred embodiment of a shell casing unloading device having variable speed common axis control sprockets in accordance with the present invention.

A shell casing unloading device, in accordance with the invention, is shown in FIG. 4. As embodied herein, shell casing unloading device 40 preferably includes the following components.

In accordance with the invention, a first rotatable shaft is provided, having a first circular gear and a first non-circular gear fixed thereto, the first shaft configured to be driven by a power source. As shown in FIG. 4, first shaft 42 is driven by a power source (not shown) coupled to a drive gear 44 provided at one end of first shaft 42. At the other end of first shaft 42 are two gears, fixed to rotate with first shaft 42. One gear, designated 46, preferably has a non-circular shape, while the other gear, designated 48, preferably has a circular shape. The reason for these preferred shapes is discussed in greater detail below.

In accordance with the invention, a second rotatable shaft is provided, having a gear fixed thereto and engaged with the first, preferably non-circular, gear, and a first sprocket and hub fixed thereto to rotate with the second shaft. As embodied in FIGS. 4 and 5, a second rotatable shaft 52 has a gear 54, that preferably has a non-circular shape, and a first hub 50 and a first sprocket 56 are fixed to the shaft 52.

First sprocket 56 can have a number of openings for handling shell casings 28. In the preferred embodiment, first sprocket 56 has five openings. Moreover, in the preferred embodiment, first sprocket 56 is positioned in shell casing unloading device 40 to handle the forward end "f" of each shell casing 28.

Figure 5:
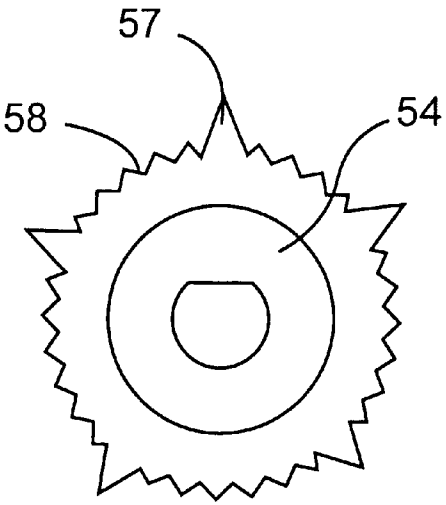
FIG. 5 is a front view of a preferred embodiment of a non-circular gear suitable for use with the variable speed common axis control sprockets of FIG. 4.

The gear 54 has a non-circular shape that is mathematically compatible with that of noncircular gear 46, as explained below. The non-circular gears 54 and 46 can have a variety of shapes. FIG. 5 depicts a preferred shape, a fifth order gear shape having five (5) raised portions 57, and five (5) lowered portions 58. This fifth order shape for non-circular gears 54 and 46 is to be used with a sprocket 56 having five openings. However, the invention is not limited to a sprocket or non-circular gear having this shape. For example, if sprocket 56 is configured to have two openings, gears 54 and 46 would be second order gears.

In accordance with the invention, a second hub and second sprocket are mounted around the second shaft, and rotatable independently of the second shaft. A second circular gear is engaged to rotate with the first circular gear, and the second sprocket is fixed to rotate with the second hub. As shown in FIG. 4, a second hub 60 is mounted coaxially with first hub 50 concentrically about shaft 52, rotatable relative to shaft 52 and independently of shaft 52. A gear 62, preferably a circular gear, is mounted to second hub 60, and a second sprocket 64 is also mounted to second hub 60. Second sprocket 64 has the same number of openings as first sprocket 56. Second sprocket 64 handles the after end "a" of each shell casing 28.

Second circular gear 62 engages with first circular gear 48, and is driven by first circular gear 48. Rotation of second circular gear 62 in turn rotates second hub 60 and second sprocket 64.

In accordance with the invention, because gears 48 and 62 preferably are circular-shaped, rotation of first shaft 42 by the power source, which occurs generally at a constant first speed $V_1$, rotates second hub 60 and second sprocket 64, at the same generally constant first speed $V_1$. Hence, assuming that the power source drives the system at the constant first speed $V_1$, which would be the case during normal operation, the second sprocket 64 engaging the after end of shell casings 28 also will rotate at the constant first speed $V_1$.

However, also in accordance with the invention, the forward end "f" of each shell casing 28 will be controlled by the first sprocket 56, rotating at a variable velocity. This variable velocity is caused by the preferably non-circular shapes of engaged gears 46 and 54, and further because shaft 52 second hub 60 are separate and rotate independently of one another. Engagement of the preferably non-circular gears 46 and 54 causes shaft 52 to rotate at a variable velocity, alternating between a velocity generally equal to first velocity $V_1$ of the second hub 60, and other velocities that are different than first velocity $V_1$. Because shaft 52 rotates independently of second hub 60, and is driven by a different gear set, shaft 52 and first sprocket 56 will alternatively decelerate to velocities including velocity $V_2$, which are less than $V_1$, so that first sprocket 56 lags behind second sprocket 64, then accelerate through a number of higher velocities until it returns back to velocity $V_1$ so that the sprockets rotate together. The velocity profile of the shaft 52 and first sprocket 56 is determined by the non-circular gear geometry.

The purpose for the variable velocity of first sprocket 56 is to allow for the retardation of the forward end "f" of shell casing 28 to facilitate its passage through the unloading path, then accelerate the forward end "f" to catch up with the after end "a" of the shell casing 28.

Tests of the above described invention incorporated into a high rate of fire gun ammunition handling system showed a 98% reduction of dented brass shell casings. These figures represent a significant improvement over conventional ammunition handling systems.

Modifications can be made to the above-described embodiment. For example, it is preferred that the forward sprocket 56 be driven at a variable speed by a non-circular gear fixed to its shaft, and that aft sprocket 64 be driven at a constant speed by a circular gear fixed to the coaxial hub. However, these gear shapes are only one way to produce the desired velocity profiles of the forward and after sprockets. Any gear shape, combination, or alternative drive source suitable to decelerate the forward sprocket 56, to allow the retardation of the forward end "f" of the shell casing 28, to lag momentarily behind aft sprocket 64 and after end "a" of the shell casing 28, and then accelerate the forward sprocket and forward end of the shell casing to catch up to the aft sprocket and after end of the shell casing, is suitable and within the scope of the invention.

In addition, it is not mandatory that aft sprocket 64 always travel at the constant velocity $V_1$. Different velocity profiles for aft sprocket 64 are possible in order to allow shell casing 28 to be unloaded from the gun without denting the shell casing 28.

It will be apparent to those skilled in the art that various additional modifications and variations can be made to the present invention without departing from the spirit or scope of the invention. The present invention covers all modifications and variations that fall within the scope of the attached claims, and their equivalents.

We claim:

1. A handling system for an object with a detachable casing comprising:

a loading sprocket for feeding the object and casing into a manipulating device, said manipulating device being configured to detach the casing from the object, and an unloading device for unloading the detached casing from the manipulating device, said unloading device comprising:

(a) a first rotatable shaft having a first circular gear and a first non-circular gear fixed thereto, said first rotatable shaft configured to be driven by a power source;

(b) a second rotatable shaft having a second non-circular gear fixed thereto and engaged with said first non-circular gear, and a first sprocket and first hub fixed thereto to rotate with said second rotatable shaft, said first sprocket configured to receive a forward end of the detached casing; and (c) a second hub mounted around a reduced diameter portion of the first hub, and rotatable independently of the first sprocket and second shaft, having a second circular gear engaged to rotate with the first circular gear, and a second sprocket fixed to rotate independently of the first sprocket and configured to receive an after end of the detached casing.

2. The object handling system of claim 1, wherein said first sprocket rotates at a variable velocity.

3. The object handling system of claim 2, wherein said first sprocket rotates at velocities varying at least between said first velocity and a second velocity that is less than said first velocity.

4. The object handling system of claim 1, wherein said second sprocket rotates at a first velocity.

5. The object handling system of claim 4, wherein said first sprocket rotates at velocities varying at least between said first velocity and a second velocity that is less than said first velocity.

6. The object handling system of claim 1, wherein said first and second sprockets have an identical number of openings, and said first and second non-circular gears have a non-circular shape corresponding to the number of openings of said first and second sprockets.

7. A handling system for an object with a detachable casing comprising:

a loading sprocket for feeding the object and casing into a manipulating device, the manipulating device configured to detach the casing from the object; and an unloading device for unloading the detached casing from the manipulating device, said unloading device comprising:

(a) a first rotatable shaft having a first circular gear and a first non-circular gear fixed thereto, said first rotatable shaft configured to be driven by a power source;

(b) a second rotatable shaft having a second non-circular gear fixed to said second rotatable shaft and engaged to rotate with said first non-circular gear, and a first sprocket and first hub fixed to said second rotatable shaft to rotate therewith, said first sprocket configured to receive a forward end of the detached casing; and (c) a second circular gear coupled to a second sprocket, said second sprocket being generally coaxial and aligned with said first sprocket, said second sprocket further being configured to receive an after end of the detached casing, said second circular gear engaged to rotate with said first circular gear.

8. The object handling system of claim 7, wherein said first sprocket rotates at a variable velocity.

9. The object handling system of claim 7, wherein said second sprocket rotates at a first velocity.

10. The object handling system of claim 7, wherein said first and second sprockets have an identical number of openings and said first and second non-circular gears have a non-circular shape corresponding to the number of openings of said first and second sprockets.

11. A handling system for an object having a detachable casing comprising:

a loading sprocket for feeding the object and casing into a manipulating device, the manipulating device configured to detach the casing from the object; and an unloading device for unloading the detached casing from the manipulating device, said unloading device comprising:

(a) a rotatable shaft having a first gear fixed thereto and a first sprocket and first hub fixed thereto spaced from said first gear, said first sprocket configured to receive a forward end of the detached casing, said first gear configured to be driven by a power source to rotate said shaft at a variable speed;

(b) a rotatable second hub provided in coaxial relation to said rotatable shaft, having a second gear and a second sprocket fixed thereto, said second sprocket configured to receive an after end of the detached casing, said second gear configured to be driven by the power source to rotate said second hub at a selected speed;

(c) wherein the variable speed of said rotatable shaft varies between a first speed generally equal to the selected speed of said second hub and a second speed that is different from the selected speed of said second hub.

12. The object handling system of claim 11, wherein the second speed is less than the first speed.

13. The object handling system of claim 11, wherein said first gear is a non-circular gear.

14. The object handling system of claim 11, wherein said second gear is a circular gear.

15. The system as in any one of claim 1, 7, or 11, wherein the object is a shell and the casing is a shell casing.

16. A casing unloading device for use in a system for handling objects, each object including a detachable casing, comprising:

(a) a first rotatable shaft having a first circular gear and a first non-circular gear fixed thereto, said first rotatable shaft configured to be driven by a power source;

(b) a second rotatable shaft having a second non-circular gear fixed thereto and engaged with said first non-circular gear, and a first sprocket fixed thereto to rotate with said second rotatable shaft, said first sprocket configured to receive a forward end of the casing after being detached from the object, and a first hub intermediate said second non-circular gear and said first sprocket;

(c) a second hub mounted around a reduced diameter portion of said first hub and rotatable independently of said second rotatable shaft, having a second circular gear engaged to rotate with said first circular gear, and a second sprocket aligned with said first sprocket fixed to rotate with said second hub.

17. The unloading device of claim 16, wherein said first sprocket rotates at a variable velocity.

18. The unloading device of claim 16, wherein said second sprocket rotates at a first velocity.

19. The unloading device of claim 18, wherein said first sprocket rotates at velocities varying at least between the first velocity and a second velocity that is less than the first velocity.

20. The unloading device of claim 16, wherein said first and second sprockets have an identical number of openings, and said first and second non-circular gears have a non-circular shape corresponding to the number of openings of said first and second sprockets.

21. A casing unloading device for use in a system for handling objects having detachable casings, comprising:

(a) a first rotatable shaft having a first circular gear and a first non-circular gear fixed thereto, said first rotatable shaft configured to be driven by a power source;

(b) a second rotatable shaft having a second non-circular gear fixed to said second rotatable shaft and engaged to rotate with said first non-circular gear, and a first sprocket and first hub fixed to said second rotatable shaft to rotate therewith, said first sprocket configured to receive a forward end of the casing after being detached from the object; and (c) a second circular gear coupled to a second sprocket, said second sprocket being generally coaxial and aligned with said first sprocket, said second circular gear engaged to rotate with said first circular gear.

22. The unloading device of claim 21, wherein said first sprocket rotates at a variable velocity.

23. The unloading device of claim 21, wherein said second sprocket rotates at a first velocity.

24. The unloading device of claim 21, wherein said first sprocket rotates at velocities varying at least between the first velocity and a second velocity that is less than the first velocity.

25. The unloading device of claim 21, wherein said first and second sprockets have an identical number of openings and said first and second non-circular gears have a non-circular shape corresponding to the number of openings of said first and second sprockets.

26. The system in any one of claim 16 or 21, wherein the object is a shell and the casing is a shell casing.

27. A casing unloading device for use in a system for handling objects, each object including a detachable casing, comprising:

(a) a rotatable shaft having a first gear fixed thereto and a first sprocket and first hub fixed thereto spaced from said first gear, said first sprocket configured to receive a forward end of the casing after being detached from the object, said first gear configured to be driven by a power source to rotate said shaft at a variable speed; and (b) a rotatable second hub portion provided in coaxial relation to said rotatable shaft, having a second gear and a second sprocket fixed thereto, said second sprocket configured to receive an after end of the detached casing, said second gear configured to be driven by the power source to rotate said second hub at a selected speed;

(c) wherein the variable speed of said shaft varies between a first speed generally equal to the selected speed of said second hub, and a second speed that is different from the selected speed of said second hub.

28. The unloading device of claim 27, wherein the second speed is less than the selected speed.

29. The unloading device of claim 27, wherein the first gear is a non-circular gear.

30. The unloading device of claim 27, wherein said first sprocket rotates at a variable velocity.

31. A handling system comprising:

a manipulating device for manipulating objects having detachable casings, a loading sprocket for feeding the object and casing into said manipulating device; and an unloading device for unloading the detached casing from said manipulating device, said unloading device comprising:

(a) a first rotatable shaft having a first circular gear and a first non-circular gear fixed thereto, said first rotatable shaft configured to be driven by a power source;

(b) a second rotatable shaft having a second non-circular gear fixed thereto and engaged with said first non-circular gear, and a first sprocket and first hub fixed thereto to rotate with said second rotatable shaft, said first sprocket configured to receive a forward end of the detached casing; and (c) a second hub mounted around said first hub and rotatable independently of said second rotatable shaft, having a second circular gear engaged to rotate with said first circular gear, and a second sprocket aligned with said first sprocket fixed to rotate with said second hub, said second sprocket configured to receive an after end of the detached casing.

32. A system comprising:

a manipulating device for manipulating objects having detachable casings;

a loading sprocket for feeding the object and casing into said manipulating device; and an unloading device for unloading the detached casing from said manipulating device, said unloading device comprising:

(a) a first rotatable shaft having a first circular gear and a first non-circular gear fixed thereto, said first rotatable shaft configured to be driven by a power source;

(b) a second rotatable shaft having a second non-circular gear fixed to said second shaft and engaged to rotate with said first non-circular gear, and a first sprocket and first hub fixed to said second rotatable shaft to rotate therewith, said first sprocket configured to receive a forward end of the detached casing; and (c) a second circular gear coupled to a second sprocket, said second sprocket being generally coaxial and aligned with said first sprocket, said second sprocket further being configured to receive an after end of the detached casing, said second circular gear engaged to rotate with said first circular gear.

33. A system comprising:

a manipulating device for manipulating objects having detachable casings;

a loading device for feeding the object and casing into said manipulating device, and an unloading device for unloading the detached casing from the manipulating device, said unloading device comprising:

(a) a rotatable shaft having a first gear fixed thereto and a first sprocket and first hub fixed thereto spaced from said first gear, said first sprocket configured to receive a forward end of the detached casing, said first gear configured to be driven by a power source to rotate said rotatable shaft at a variable speed;

(b) a rotatable second hub provided in coaxial relation to said rotatable shaft, having a second gear and a second sprocket fixed thereto, said second sprocket configured to receive an after end of the detached casing, said second gear configured to be driven by the power source to rotate said second hub at a selected speed;

(c) wherein the variable speed of said rotatable shaft varies between a first speed generally equal to the selected speed of said second hub, and a second speed that is different from the selected speed of said second hub.

34. The system as in any one of claim 27, 31, 32, or 33, wherein the object is a shell and the casing is a shell casing.

* * * * *